US006260961B1

(12) United States Patent
Seu et al.

(10) Patent No.: US 6,260,961 B1
(45) Date of Patent: Jul. 17, 2001

(54) UNITARY ONE-PIECE BODY STRUCTURE FOR INK-JET CARTRIDGE

(75) Inventors: Preston Seu, Vancouver, WA (US); Patrick Boyd; Gary Powell, both of Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/516,922

(22) Filed: Mar. 2, 2000

(51) Int. Cl.[7] ..... B41J 2/175
(52) U.S. Cl. ..... 347/87
(58) Field of Search ..... 347/85, 86, 87; 264/245, 249, 251

(56) References Cited

U.S. PATENT DOCUMENTS

| | | | | |
|---|---|---|---|---|
| 4,771,295 | | 9/1988 | Baker et al. | 347/87 |
| 5,497,178 | | 3/1996 | DeFosse et al. | 347/87 |
| 5,515,092 | | 5/1996 | Swanson et al. | 347/87 |
| 6,003,983 | * | 12/1999 | Lowry et al. | 347/85 |
| 6,070,974 | * | 6/2000 | Kotaki et al. | 347/86 |

* cited by examiner

*Primary Examiner*—N. Le
*Assistant Examiner*—Anh T. N. Vo

(57) ABSTRACT

A multi-compartment ink-jet cartridge body structure, including a unitary body having a plurality of ink reservoir compartments. Each compartment includes an outlet port through which ink passes to feed ink to an ink-jet printhead nozzle array. The body further includes a printhead nozzle array mounting region, and an ink manifold structure including a plurality of corresponding ink channels each leading from a corresponding outlet port to a feed opening formed at the printhead mounting region. The body and manifold structure are formed as a unitary one-piece structure. A lid is attached to the unitary body to cover the compartments. The body includes an external wall, and an access opening is formed in the wall adjacent the manifold structure. A seal structure attached to the body for sealing the access opening. The body structure can be fabricated by a plastic material using an injection molding process. The access opening is a mold slide insert opening in the nosepiece area, and the seal structure seals the slide insert opening. The molding process can be carried out by a three piece mold set to fabricate the body.

28 Claims, 6 Drawing Sheets

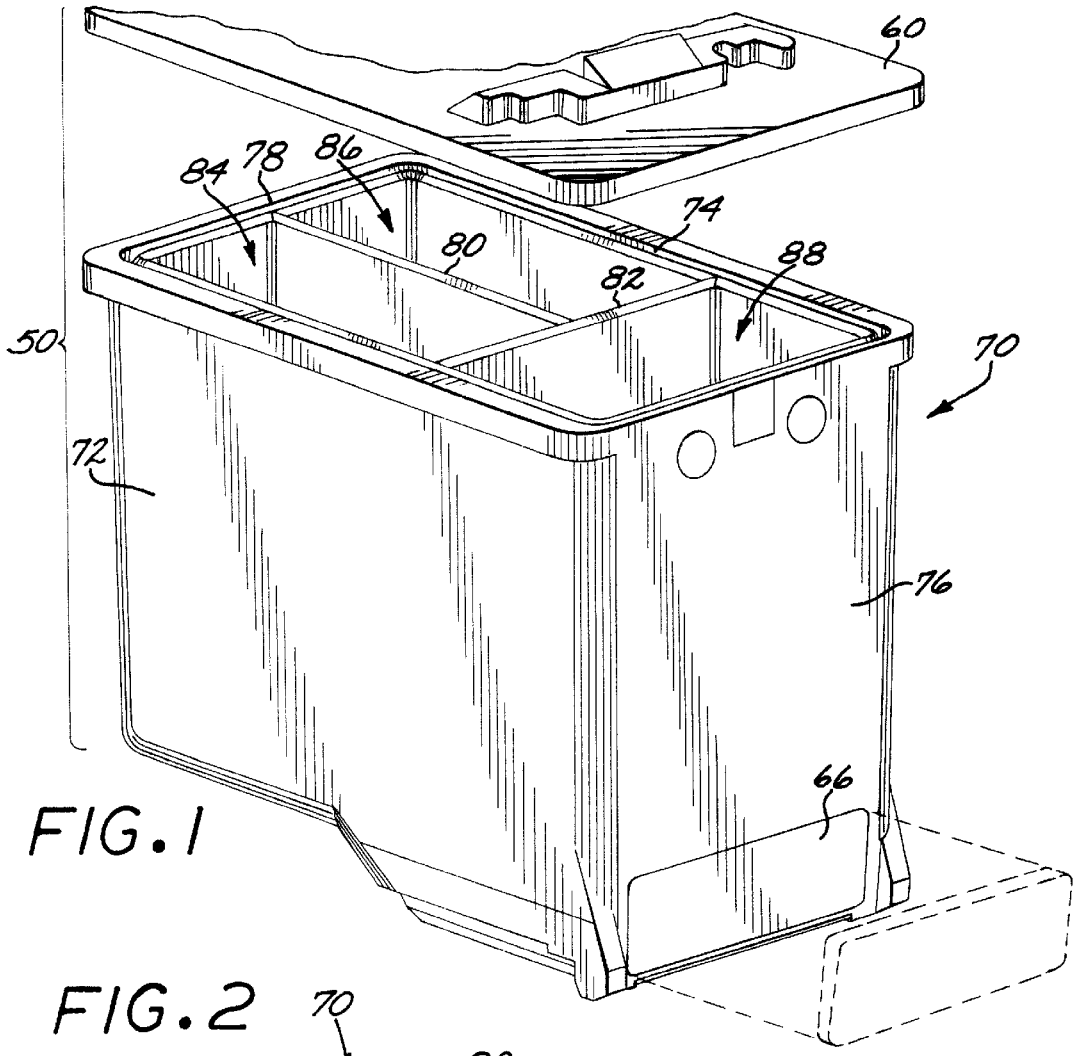
FIG. 1
FIG. 2
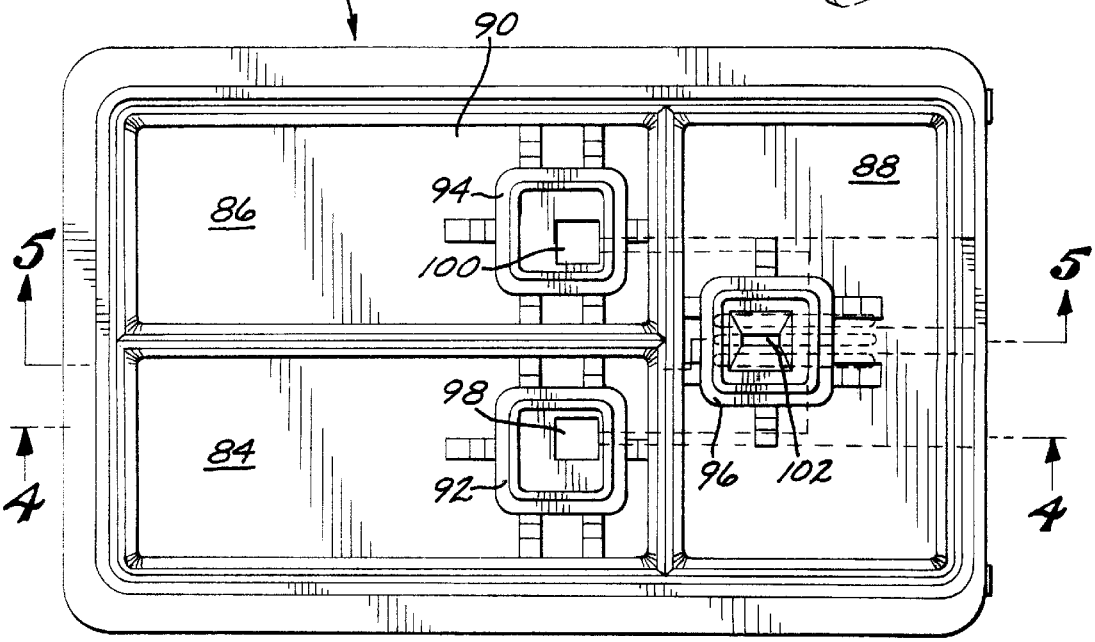

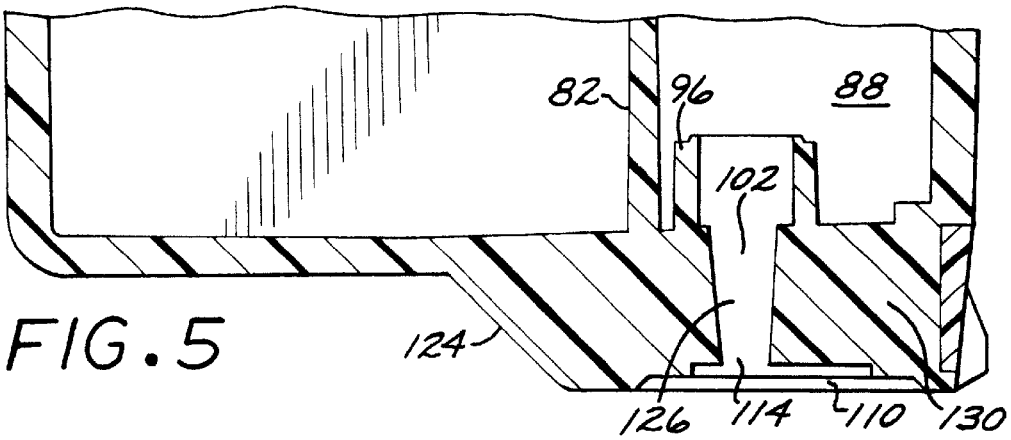
FIG. 5
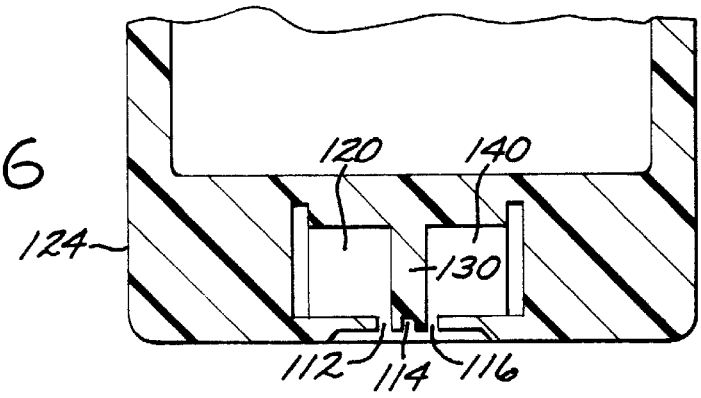
FIG. 6
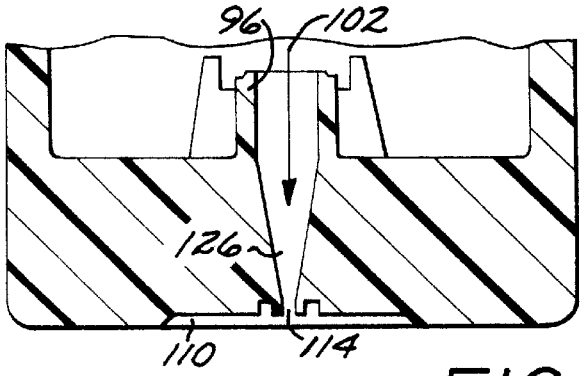
FIG. 7
FIG. 8
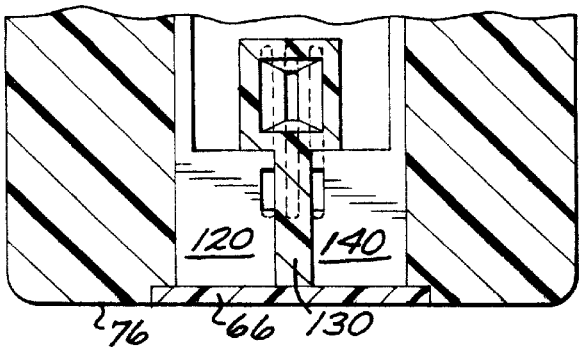
FIG. 9
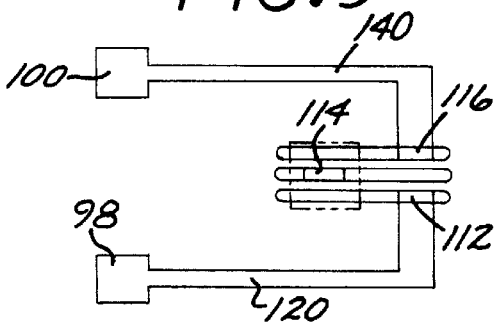

UNITARY ONE-PIECE BODY STRUCTURE FOR INK-JET CARTRIDGE

TECHNICAL FIELD OF THE INVENTION

The present invention relates to techniques for constructing ink jet print cartridges.

BACKGROUND OF THE INVENTION

Ink-jet printers are in widespread use today for printing functions in personal computer, facsimile and other applications. Such printers typically include replaceable or semi-permanent print cartridges which hold a supply of ink and carry the ink-jet printhead. The cartridge typically is secured into a printer carriage which supports one or a plurality of cartridges above the print medium, and traverses the medium in a direction transverse to the direction of medium travel through the printer. Electrical connections are made to the printhead by flexible wiring circuits attached to the outside of the cartridge. Each printhead includes a number of tiny nozzles defined in a substrate and nozzle plate structure which are selectively fired by electrical signals applied to interconnect pads to eject droplets of ink in a controlled fashion onto the print medium.

Multicolor cartridges are known which have multiple ink reservoirs and multiple printhead nozzle arrays, one of each for each different color of ink. A manifold structure is typically employed to direct the inks of different colors from the respective reservoirs to corresponding printhead nozzle arrays. The cartridges typically include a body structure to which the printhead structure is attached. Typically the body structures and manifolds for multicolor cartridges have been assembled from multiple plastic parts, which are then bonded together by techniques such as ultrasonic welding. Leaks and mislocation of the respective parts are perennial problems.

SUMMARY OF THE INVENTION

In accordance with one aspect of the invention, a multi-compartment inkjet cartridge body structure is described, including a unitary body having a plurality of ink reservoir compartments. Each compartment includes an outlet port through which ink passes to feed ink to an ink-jet printhead nozzle array. The body further includes a printhead nozzle array mounting region, and an ink manifold structure including a plurality of corresponding ink channels each leading from a corresponding outlet port to a feed opening formed at the printhead mounting region. The body and manifold structure are formed as a unitary one-piece structure. A lid is attached to the unitary body to cover the compartments.

According to another aspect, the body includes an external wall, and an access opening is formed in the wall adjacent the manifold structure. The body structure further includes a seal structure attached to the body for sealing the access opening.

The body structure can be advantageously fabricated by a plastic material using an injection molding process. In this case, the access opening is a mold slide insert opening in the nosepiece area, and the seal structure seals the slide insert opening. The molding process includes a three piece mold set to fabricate the body.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is an exploded isometric view of an ink-jet cartridge body structure employing a unitary body structure in accordance with the invention.

FIG. 2 is a top view of the unitary body structure of the cartridge of FIG. 1.

FIG. 5 is a partial longitudinal cross-sectional view of the body structure taken along line 5—5 of FIG. 2.

FIG. 6 is a partial cross-section view of the body structure taken along line 6—6 of FIG. 4.

FIG. 7 is a partial cross-sectional view of the body structure taken along line 7—7 of FIG. 4.

FIG. 8 is a cross-sectional view of the nosepiece region taken along line 8—8 of FIG. 4.

FIG. 9 is a schematic diagram illustrative of the ink flow paths from the respective ink compartments to the ink slots in the nose piece area.

FIG. 12 is a partial bottom view of the mold core of the set of molds.

DETAILED DESCRIPTION OF THE PREFERRED EMBODIMENT

Figure 3:
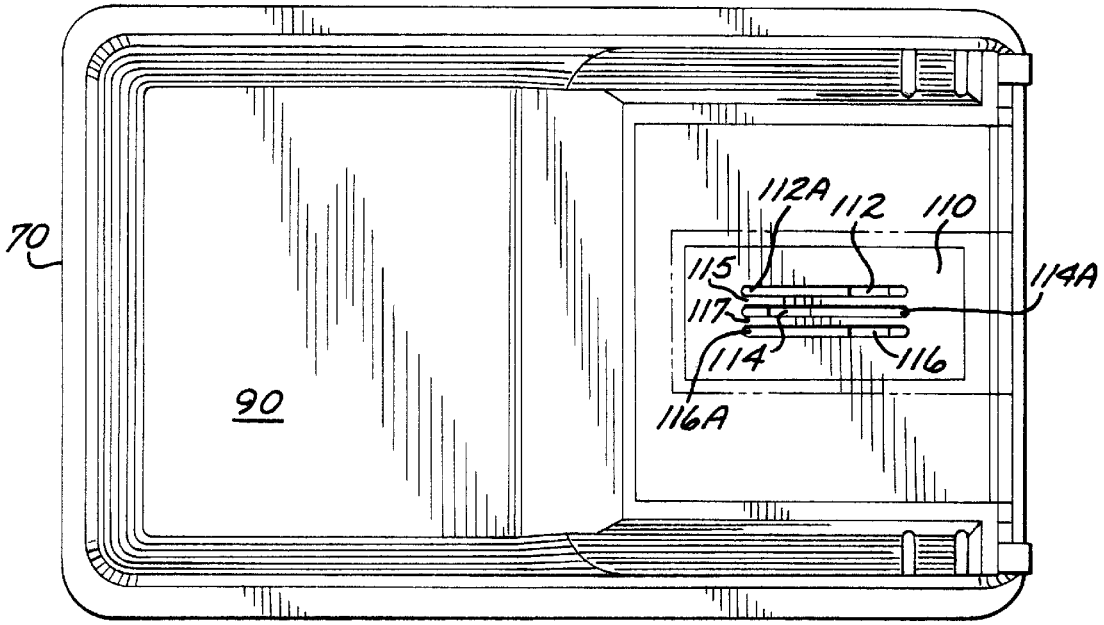
FIG. 3 is a bottom view of the unitary body structure.

An exemplary ink-jet cartridge body structure assembly 50 constructed in accordance with this invention is illustrated in FIG. 1, and includes a separate top lid 60 and a unitary body 70. The body 70 is a one-piece injection molded part in this embodiment, with a single sealing member 66 for sealing a mold slide insert access hole in the body after the molding process is completed.

The body 70 includes two interior walls which meet in a "T"to define with the body side walls three ink compartments. Thus, the body 70 has opposed longitudinal side walls 72, 74, and opposed end walls 76, 68 which define an interior cartridge volume. A longitudinally oriented interior wall 80 is equally spaced from the two longitudinal walls 72, 74, and meets transverse interior wall 82 which runs between walls 72, 74 and is parallel to the end walls 76, 78. The exterior walls 72–78 and the interior walls 80–82 with a bottom wall structure described below define three interior ink compartments 84, 86, 88. In one embodiment, the length of the wall 80 is selected such that the respective volumes of the compartments are equal. In other embodiments, the wall length could be selected such that the volume of compartment 88 is larger or smaller than the volumes of compartments 86 and 88. A larger compartment could be used for an ink color which typically experiences higher usage rates than ink color for the inks held in the compartments 86, 88. The compartments in this exemplary embodiment receive foam structures (not shown in FIG. 1) which hold the ink in open foam cells, and create slight negative pressure through capillary action, as is well known in the art.

FIG. 2 shows a top view of the body 70, illustrating the three compartments 84–88 and the bottom wall structure 90. Also shown are respective standpipe structures 92, 94, 96 which protrude from the bottom wall and engage the foam structures when installed in the compartments. The bottom wall structure has defined therein openings 98, 100, 102 in the respective compartments to allow ink to flow into ink channels defined in a nosepiece region below the bottom wall 90 to ink feed slots at a printhead mounting region.

FIG. 3 is bottom view of the body 70, illustrating the printhead mounting region 110 and respective ink feed slots 112, 114, 116 which are formed in grooves 112A, 114A, 116B formed in the printhead mounting region. Narrow lands 115 and 117 are defined between adjacent grooves 112A, 114A and 114A, 116A. In this exemplary embodiment, the slots and lands have widths of 0.5 mm, so that the slots are spaced 1 mm apart center-to-center. As will be explained more fully below, a printhead structure with three ink-jet nozzle arrays are mounted to the region 110. The nozzle arrays are fed by ink flowing through the respective feed slots from the ink compartments.

Figure 4:
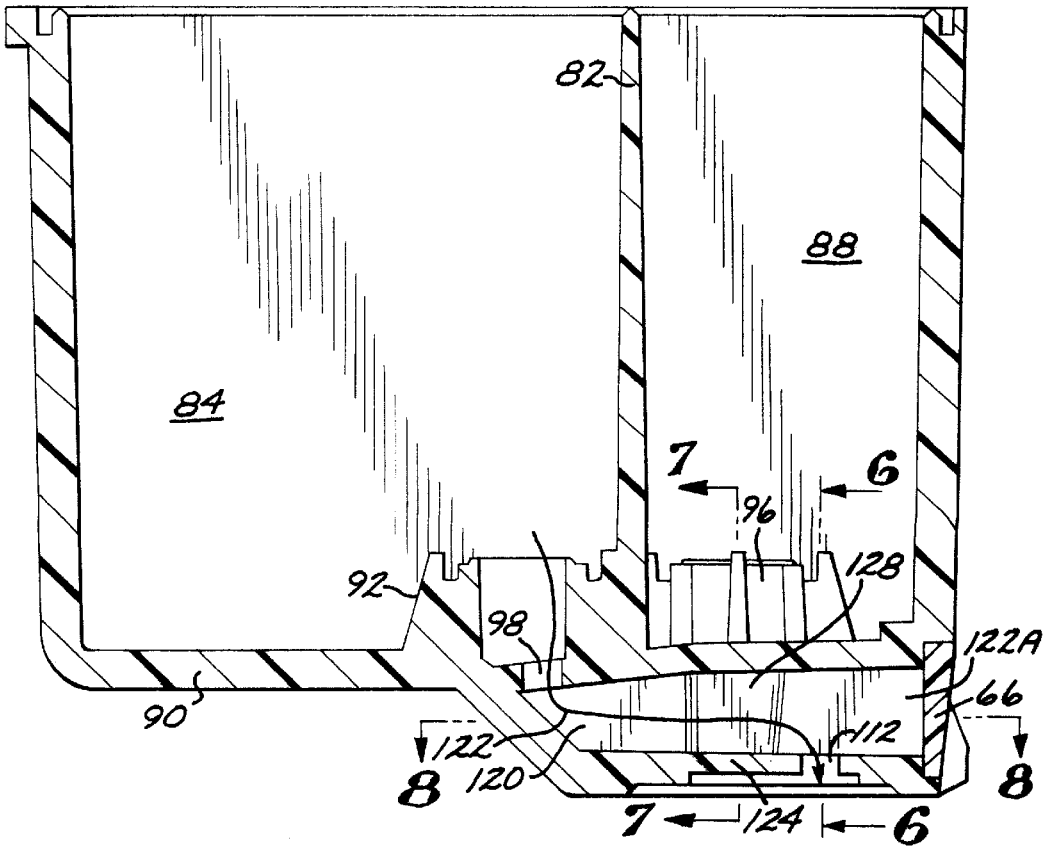
FIG. 4 is a longitudinal cross-sectional view of the body structure taken along line 4—4 of FIG. 2.

The cross-sectional view of FIG. 4, taken along line 4—4 of FIG. 2, illustrates the nosepiece structure 124, the structure of the standpipe 92, and the opening 98 formed through the bottom compartment wall 90. The opening 98 is in communication with a side ink channel 120, which leads to ink feed slot 112 formed in the nosepiece bottom wall 124 in the mounting region 110. The channel 120 thus provides an ink flow path, indicated by arrow 122, from reservoir 84 through opening 98, through the channel 120 and feed slot 112 to the printhead mounting region 110. Also visible in FIG. 4 is the standpipe structure 96 for the front compartment 88.

FIG. 5 shows a cross-section of the nosepiece and front compartment 88, with the standpipe structure 96 and opening 102, which tapers into the feed slot 114 formed in the printhead mounting region 110 of the nosepiece. It will be seen that opening 102 communicates directly with the printhead mounting region 110 through vertical channel 126 to slot 114. This feature is further illustrated in the cross-sectional view of FIG. 7. The vertical channel 126 is formed through nosepiece structure at 128 (FIG. 4).

A nosepiece wall structure 130 runs between the nosepiece structure at 128 up to the slide insert opening 76A formed in the wall 76 of the body. When the sealing structure 66 is mounted in the opening 76A, it is sealed to the wall 76 at the periphery of the opening and also to the exposed edge of the wall 130 in this exemplary embodiment, to prevent ink from one side channel from mixing with ink from the other side channel. This is illustrated in FIG. 8.

FIG. 9 schematically illustrates the side ink channels 120 and 140, which respectively run from the outlet ports 98, 100 formed in the respective reservoirs 84, 86 to the ink flow slots 112, 116 in the nosepiece bottom wall at the printhead mounting region.

Figures 10A, 10B:
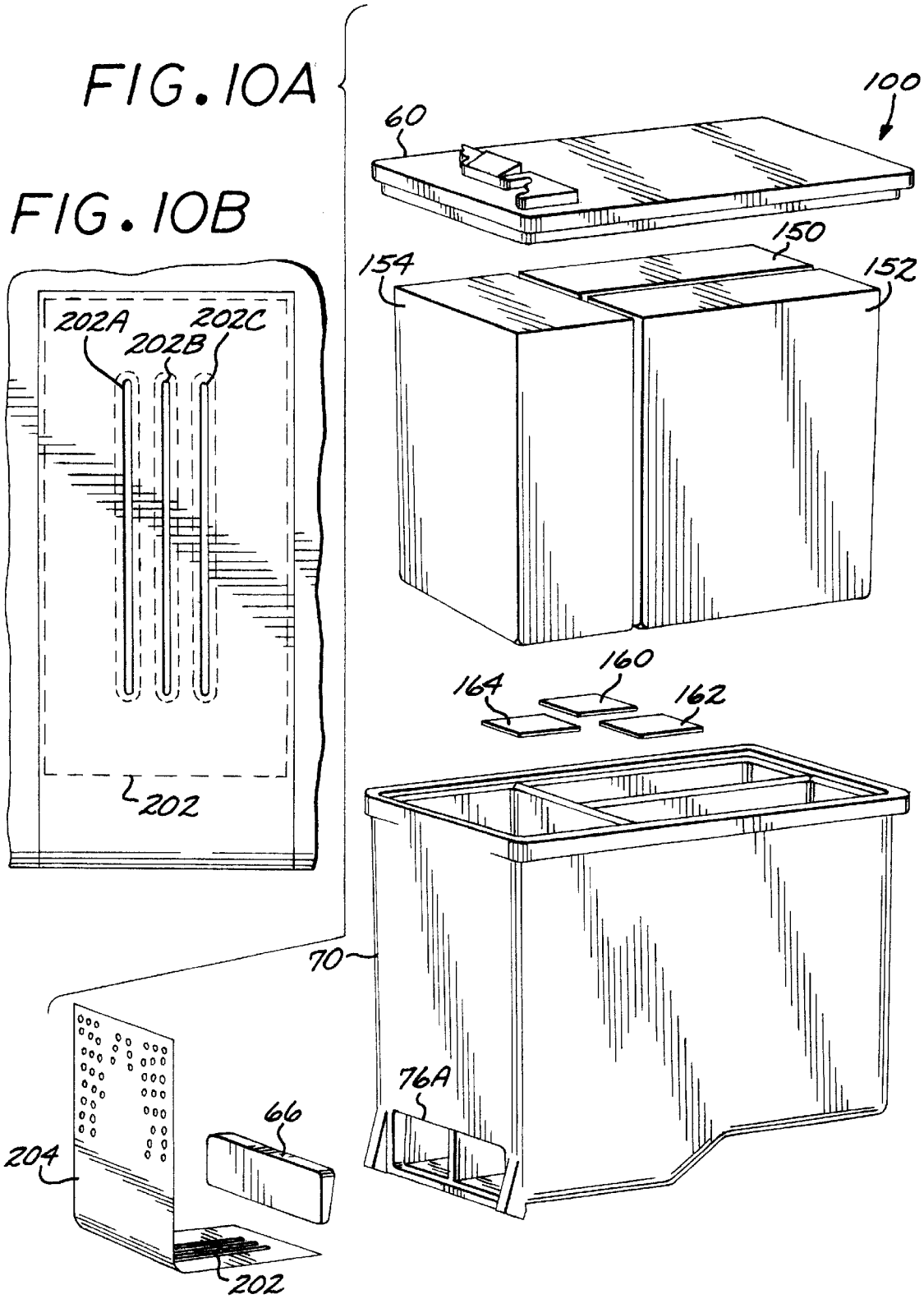
FIG. 10A is an exploded view of the inkjet print cartridge of FIG. 1 with the printhead TAB circuit, foam and filter screen elements.
FIG. 10B is a bottom view of the printhead substrate employed in the printhead TAB circuit.

FIG. 10A illustrates in exploded view an ink-jet cartridge 200 a unitary cartridge structure 70 and lid 60 as described with respect to FIGS. 1–9. The cartridge 200 includes a printhead substrate 202 assembled to a TAB circuit 204, which is mounted to the cartridge body 70. The TAB circuit 204 has formed thereon the connecting circuit traces and pads used to interconnect firing resistors with the printer driver circuits, as is generally well known in the art. The substrate 202 has formed in the planar surface adjacent the mounting region three feed slots 202A, 202B, 202C (FIG. 10B) which feed the firing chambers (not shown) of the printhead substrate with liquid ink. These substrate slots are positioned so that each substrate slot is adjacent a corresponding feed slot 112, 114, 116 at the printhead mounting region 110. The printhead is fixed to the printhead mounting region 110 of the body structure 70 in this exemplary embodiment by adhesive beads formed around the periphery of each feed slot 112, 114, 116 to form a barrier between the respective ink feed slots and so as to direct ink from one reservoir to the appropriate substrate feed slot on the substrate 202. The use of adhesive to attach printhead substrates to body mounting regions is known in the art.

In an exemplary embodiment, each substrate slot 202A–202C is associated with a corresponding printhead nozzle array, such that ink supplied to a given substrate slot will feed firing chambers of the corresponding nozzle array. three color cartridge, there will be three nozzle arrays, and each will be positioned to receive ink from a corresponding one of the supply reservoirs 84–88.

Also shown in FIG. 10 are the three foam bodies 150, 152, 154 which are inserted into the corresponding reservoirs 84–88. The foam bodies create slight negative pressure to prevent ink drool from the printhead nozzles under nominal conditions, as is known in the art. Fine mesh filters 160, 162, 164 are fitted over the respective standpipe openings and between the standpipes and the foam structures to provide filtration of particulates and air bubbles.

Figure 11:
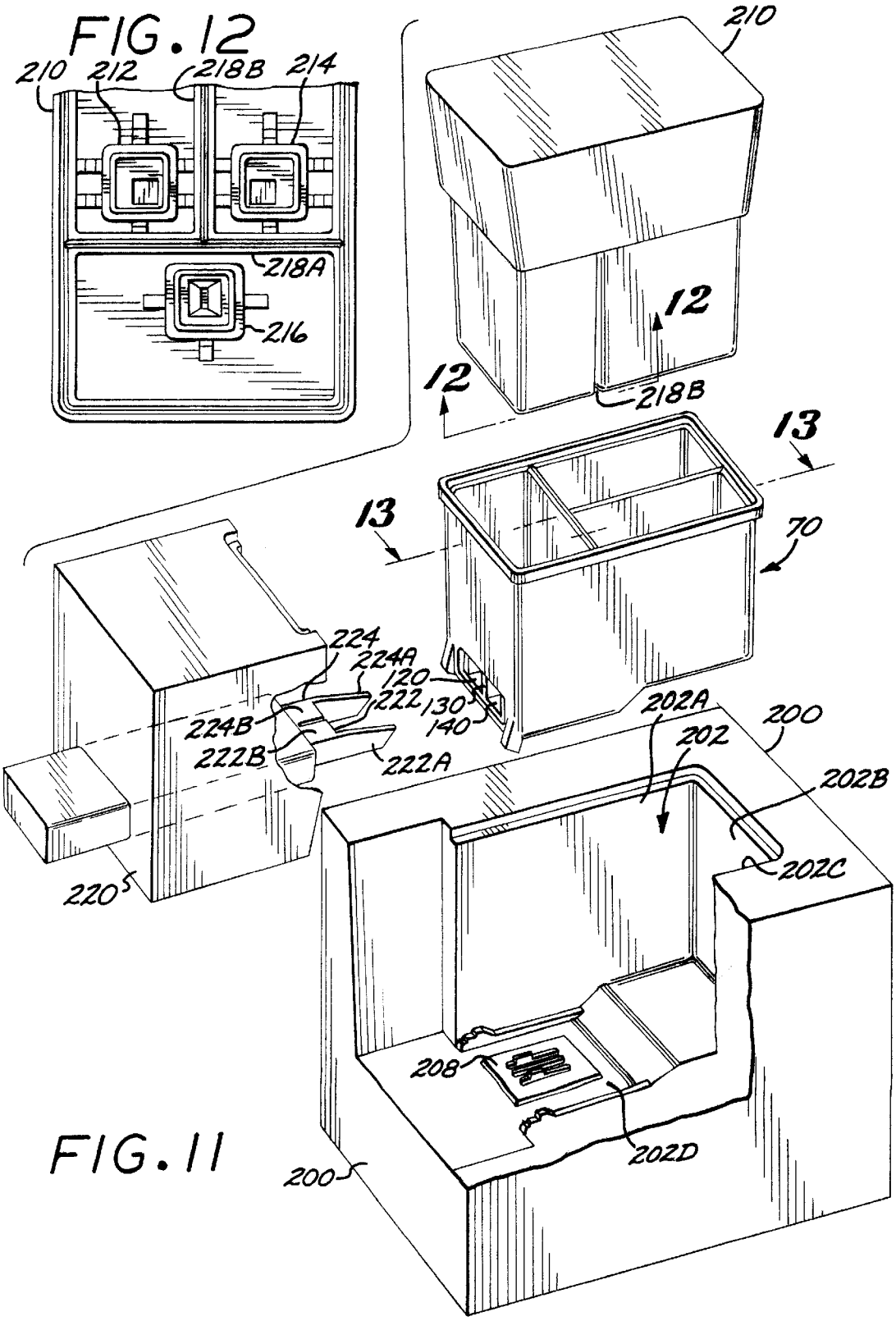
FIG. 11 illustrates in simplified isometric form an exemplary set of molds and molding technique used to fabricate the unitary body structure for the ink-jet cartridge of FIGS. 1–10.
Figure 13:
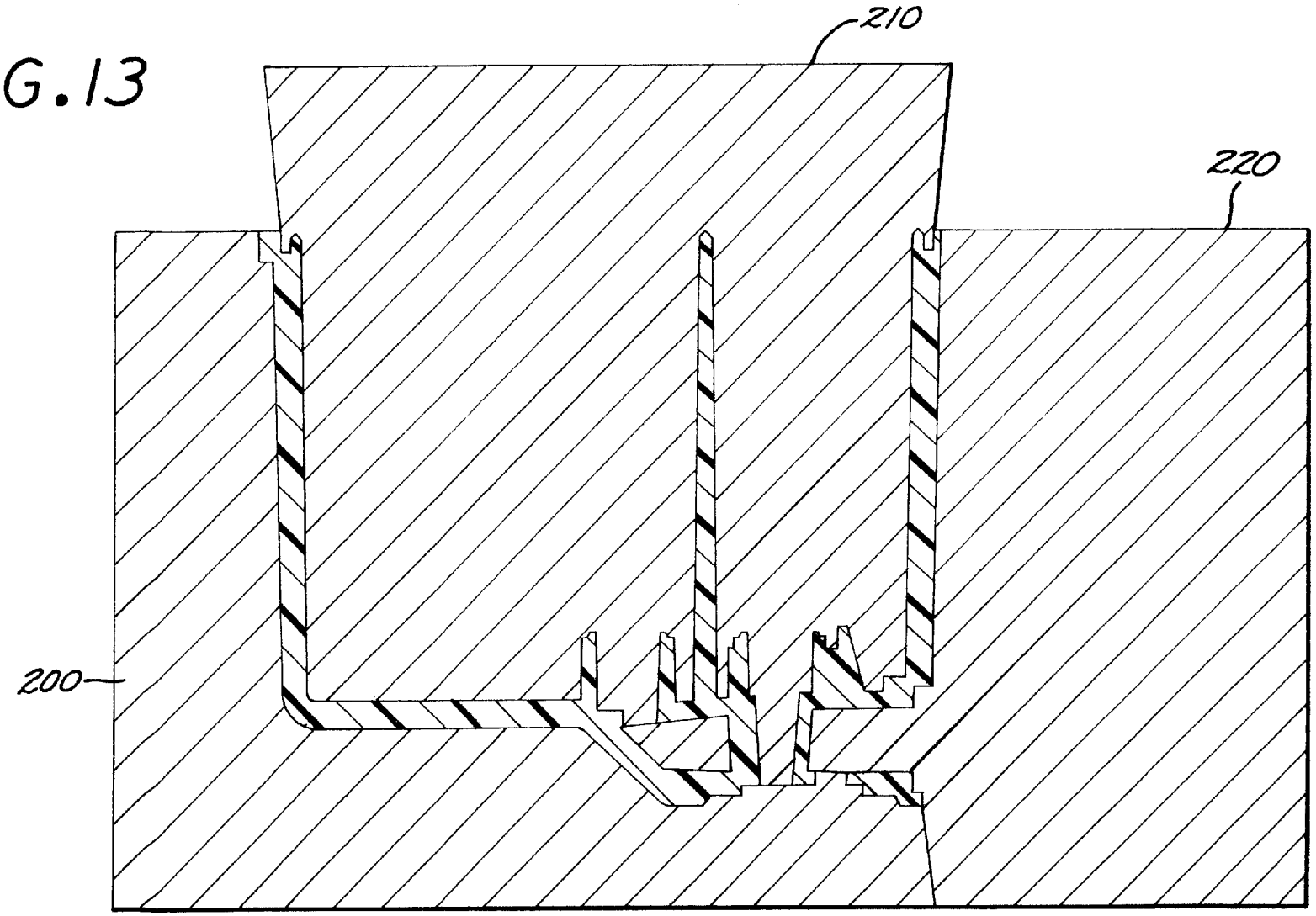
FIG. 13 is a longitudinal cross-section view taken through line 13—13 of FIG. 11, illustrating the molds after the molten plastic material has been injected into the mold set to form the unitary body structure.

FIGS. 11–13 illustrate exemplary molding techniques for injection molding the unitary cartridge body structure 70. A cavity mold 200 defines a cavity 202 and includes walls 202A, 202B, 202C and 202D which define the external surfaces of the walls 72, 74, 78 and the bottom of the body structure 70. The bottom wall 202D includes features for defining the external features of the nosepiece region of the body 70, including protruding feature 208 which defines the printhead mounting region and the ink feed slots at the mounting region.

A mold core 210 is inserted into the cavity 202 in preparation for the molding process and includes voids such as voids 212, 214, 216 and 218A–218B to define interior features of the body 70. For example, voids 212, 214 and 216 define the standpipes 92, 92 and 96, and voids 218A–218B (FIG. 12) define the interior walls 82–80.

A mold slide 220 fits into the cavity 202 in preparation for the molding process, and includes mold features to define the exterior surface of wall 76, and also includes slide inserts 222 and 224 which define the side ink channels. Slide insert 222 includes a narrow tine portion 222A protruding from a rectilinear pin portion 222B. Similarly, pin 224 includes a narrow tine portion 224A protruding from a rectilinear pin portion 224B. The narrow tine portions define channel portions connecting to the outlet ports 100 and 98, respectively. The rectilinear portions define the larger chambers 122A, 142A in the nosepiece region 124.

FIG. 13 is a cross-sectional view taken along line 13—13 of FIG. 11, illustrating the mold pieces 200, 210 and 220 in position for a molding process. FIG. 13 illustrates the case in which the molten plastic has been injected into the mold voids, but prior to disassembly of the mold pieces to remove a molded part. The disassembly occurs by first removing mold slide 220, then the cavity mold 200, and finally the molded part is removed from the core piece 210 in this exemplary embodiment. Subsequent to removal of the part from the mold, the seal member 66 is attached to the body 70, e.g., by ultrasonic welding or by adhesive.

The body 79 is preferably fabricated from a vapor barrier material to prevent ink from diffusing through the body walls. An exemplary material suitable for the purpose and for injection molding is glass-reinforced PET, although other materials can alternatively be employed.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A multi-compartment ink-jet cartridge body structure, comprising:

a unitary body having a plurality of ink reservoir compartments and an external wall, each compartment including an outlet port through which ink passes to feed ink to an ink-jet printhead nozzle array, a printhead nozzle array mounting region, and an ink manifold structure including a plurality of corresponding ink channels each leading from a corresponding outlet port to a feed opening formed at the printhead mounting region, the body and manifold structure formed as a unitary one-piece structure, said plurality of ink channels including a first ink channel leading from a first outlet port for a first ink reservoir compartment to a first feed opening and a second ink channel leading from a second outlet port for a second ink reservoir compartment, said first channel and said second channel including respective first and second channel portions extending in a generally parallel relationship to an access opening formed in said external wall;

a seal structure attached to the body for sealing the access opening; and a lid attached to the unitary body to cover the compartments.

2. The body structure of claim 1 wherein the body and manifold structure are formed as a unitary molded part.

3. The body structure of claim 1 wherein the body further includes first and second interior walls defining the respective ink compartments, the first wall transverse to and joined to the second wall in a "T" configuration, and wherein neither of the first or second interior walls is joined to said external wall.

4. The body structure of claim 1 wherein the plurality of ink compartments have substantially equal compartment volumes.

5. The body structure of claim 1 wherein the body is fabricated of a plastic material.

6. The body structure of claim 5 wherein said plastic material is a glass-filled PET.

7. The body structure of claim 1 wherein:

the body includes a compartment bottom wall and a nosepiece structure, the nosepiece structure defining the printhead nozzle array mounting region and the manifold structure;

the compartment bottom wall is disposed between at least a portion of the each of the plurality of compartments and the nosepiece structure; and the outlet port for each compartment defined in said bottom wall.

8. The body structure of claim 7 wherein the nosepiece structure includes a bottom nosepiece wall defining said printhead nozzle array mounting region and having formed therein each said feed opening.

9. The body structure of claim 7 wherein the body further includes for each compartment a standpipe structure generally surrounding the outlet port for the compartment and extending above the bottom wall.

10. The body structure of claim 9 wherein said standpipe structure for each compartment has a rectilinear cross-sectional configuration.

11. The body structure of claim 1 wherein said sealing structure is adhesively attached to said body structure.

12. An ink-jet print cartridge, comprising:

a unitary body having a plurality of ink reservoir compartments and an external wall, each compartment including an outlet port through which ink passes to feed ink to an ink-jet printhead nozzle array, a printhead nozzle array mounting region, and an ink manifold structure including a plurality of corresponding ink channels each leading from a corresponding outlet port to a feed opening formed at the printhead mounting region, said plurality of ink channels including a first ink channel leading from a first outlet port for a first ink reservoir compartment to a first feed opening and a second ink channel leading from a second outlet port for a second ink reservoir compartment, said first channel and said second channel including respective first and second channel portions extending in a generally parallel relationship to an access opening formed in said external wall, the body and manifold structure formed as a unitary one-piece structure;

a seal structure attached to the body for sealing the access opening;

a plurality of foam members each disposed in a corresponding one of said ink reservoir compartments;

a printhead mounted to the mounting region; and a lid attached to the body to enclose the compartments.

13. The cartridge of claim 12 further including a plurality of supplies of liquid ink of different colors disposed in the respective ink compartments.

14. The cartridge of claim 12 wherein the body and manifold structure are formed as a unitary molded part.

15. The cartridge of claim 14 wherein the body includes an external wall, and an access opening formed in said wall adjacent the manifold structure, the body structure further including a seal structure attached to the body for sealing the access opening.

16. The cartridge of claim 12 wherein the body further includes first and second interior walls defining the respective ink compartments.

17. The cartridge of claim 16 wherein the first wall is transverse to and is joined to the second wall in a "T" configuration.

18. The cartridge of claim 12 wherein the plurality of ink compartments have substantially equal compartment volumes.

19. The cartridge of claim 12 wherein the body is fabricated of a plastic material.

20. The cartridge of claim 12 wherein:

the body includes a compartment bottom wall and a nosepiece structure, the nosepiece structure defining the printhead nozzle array mounting region and the manifold structure;

the compartment bottom wall is disposed between at least a portion of the each of the plurality of compartments and the nosepiece structure; and the outlet port for each compartment defined in said bottom wall.

21. The cartridge of claim 20 wherein the body further includes for each compartment a standpipe structure generally surrounding the outlet port for the compartment and extending above the bottom wall.

22. The cartridge of claim 20 wherein said standpipe structure for each compartment has a rectilinear cross-sectional configuration.

23. The cartridge of claim 12 wherein the body further includes first and second interior walls defining the respective ink compartments, the first interior wall transverse to and joined to the second interior wall in a "T" configuration, and wherein neither of the first or second interior walls is joined to said external wall.

24. The cartridge of claim 23 further comprising a circuit structure, said printhead attached to said circuit structure, the circuit structure further comprising interconnect pads on an interconnect portion of the circuit structure, and wherein the interconnect portion is attached to said external wall of said body structure.

25. The cartridge of claim 12 wherein said sealing structure is a unitary seal member which closes both said first channel portion and said second channel portion.

26. The cartridge of claim 25 wherein said seal member is adhesively attached to said unitary body.

27. The cartridge of claim 25 wherein said unitary body further includes an internal wall separating said first and second channel portions, and wherein said seal member is attached to an end of said internal wall.

28. The cartridge of claim 12, wherein said plurality of ink channels includes a third ink channel leading from a third outlet port for a third ink reservoir compartment to a third feed opening, said first outlet port and said second outlet port positioned outwardly from said third outlet port and on opposite sides thereof.

* * * * *